United States Patent [19]

Killian et al.

[11] Patent Number: 4,820,572

[45] Date of Patent: Apr. 11, 1989

[54] COMPOSITE ELASTOMERIC POLYETHER BLOCK AMIDE NONWOVEN WEB

[75] Inventors: Thomas M. Killian, Green Bay; Tony J. Wisneski, Kimberly, both of Wis.

[73] Assignee: Kimberly-Clark Corporation, Neenah, Wis.

[21] Appl. No.: 108,506

[22] Filed: Oct. 13, 1987

Related U.S. Application Data

[62] Division of Ser. No. 919,299, Oct. 15, 1986, Pat. No. 4,724,184.

[51] Int. Cl.[4] ..... D03D 3/00

[52] U.S. Cl. ..... 428/227; 428/171; 428/172; 428/231; 428/232; 428/288; 428/296; 428/903

[58] Field of Search ..... 428/227, 228, 296, 903, 428/231, 232, 171, 172

[56] References Cited

U.S. PATENT DOCUMENTS

| | | | |
|---|---|---|---|
| 2,623,031 | 12/1952 | Snyder | 260/45.4 |
| 2,903,387 | 9/1959 | Wade | 154/101 |
| 2,951,005 | 8/1960 | Hervey | 154/123 |
| 3,508,308 | 4/1970 | Bunting, Jr. et al. | 428/227 |
| 3,594,266 | 7/1971 | Okazaki | 161/173 |
| 3,642,565 | 2/1972 | Ogata et al. | 161/173 |
| 3,678,675 | 7/1972 | Klein | 428/903 |
| 3,700,545 | 10/1972 | Matsui et al. | 161/175 |
| 3,849,241 | 11/1974 | Butin et al. | 161/169 |
| 3,946,089 | 3/1976 | Furukawa | 428/395 |
| 4,100,324 | 7/1978 | Anderson et al. | 428/288 |
| 4,118,531 | 10/1978 | Hauser | 428/224 |
| 4,150,674 | 4/1979 | Yung | 428/288 |
| 4,223,101 | 9/1980 | Fine et al. | 528/76 |
| 4,323,534 | 4/1982 | Des Marais | 264/176 |
| 4,375,446 | 3/1983 | Fujii | 264/518 |
| 4,426,417 | 1/1984 | Meitner et al. | 428/195 |
| 4,426,420 | 1/1984 | Likhyani | 428/224 |
| 4,442,062 | 4/1984 | Fujii | 264/518 |
| 4,469,734 | 9/1984 | Minto et al. | 428/134 |

FOREIGN PATENT DOCUMENTS

| | | |
|---|---|---|
| 979103 | 1/1965 | United Kingdom . |
| 1575830 | 10/1980 | United Kingdom . |

OTHER PUBLICATIONS

ATO Chimie Technical Bulletin entitled PEBAX.

Rilson Ind. Inc., Material Safety Data Sheet for PEBAX.

Du Pont Co., Technical Bulletin HYT-102(R2).

E. I. Du Pont de Nemours & Co. Inc., Material Safety Data Sheet for HYTREL.

*Primary Examiner*—Sharon A. Gibson

*Attorney, Agent, or Firm*—Joseph P. Harps

[57] ABSTRACT

An elastomeric nonwoven web is formed by meltblowing fibers composed of a polyether block amide copolymer.

15 Claims, 3 Drawing Sheets

COMPOSITE ELASTOMERIC POLYETHER BLOCK AMIDE NONWOVEN WEB

This is a divisional application of application Ser. No. 919,299, filed on Oct. 15, 1986, now U.S. Pat. No. 4,724,184.

FIELD OF THE INVENTION

The present invention is generally directed to fiber formation and, in particular, to fibers which may be formed into nonwoven webs and the nonwoven web formed therefrom.

BACKGROUND OF THE INVENTION

In the field of nonwoven materials, there has been a continuing need for materials having a high degree of flexibility and elasticity. This need has persisted in spite of the fact that such materials could readily be utilized to manufacture a wide variety of garments of both the disposable type, such as disposable diapers, or the non-disposable type, such as pants, dresses, blouses and sporting wear, for example, sweatsuits. The traits of flexibility and elasticity are particularly useful characteristics in materials for use in these areas because they permit articles manufactured from such materials to closely conform to the body of the wearer or any item around which the materials may be wrapped. Additionally, the need for an absorbent nonwoven elastic material has been recognized because such a material could be utilized to manufacture a great disparity of items which have improved absorbency performance as a result of the item's ability to closely conform to a body portion or to some other item which needs to be wrapped in an absorbent material. For example, such a material could be readily utilized in the areas of feminine hygiene or wound dressing.

While the above-discussed combination of characteristics has been a goal of those of skill in the field of nonwoven materials, the prior commercial materials known to us are believed to be lacking or insufficient in one or more of the above-discussed desired characteristics. For example, one group of materials which has been available to those in treating injuries are the so-called "elastic bandages", an example of which is an elastic bandage which is commercially available from the 3M Company of Minneapolis, Minn. under the trade designation "Ace Bandage". Elastic bandages of this type are generally effective in immobilizing an injured area. However, such elastic bandages generally have a poor ability to absorb body fluids exuding from the wound.

Another material for similar uses appears in U.K. Pat. No. 1,575,830 to Johnson and Johnson which relates to flexible and absorbent dressings including diapers, surgical dressings, first aid dressings, catamenial dressings and the like. This patent further appears to relate to dressings which include an absorbent layer laminated to a plastic backing film. The backing film is stated to be elastic and easily stretchable, as well as highly flexible. The elastic backing film may be formed from a blend of materials which contains (a) a major portion of linear or radial A-B-A block copolymers or mixtures of linear or radial A-B-A block copolymers with A-B block copolymers and (b) a resin component. It is stated that the A-blocks of the block copolymers may be derived from styrene or styrene homologs and that the B-blocks may be derived from conjugated dienes or lower alkenes and the resin component may typically include a major portion of a lower molecular weight resin adapted to associate principally with the thermoplastic A-blocks of the block copolymers. It should be noted that this patent deals with an elastic film as opposed to an elastic nonwoven web.

U.S. Pat. No. 4,426,417 to Meitner appears to disclose a matrix of nonwoven fibers which can be used as a wiper with the matrix including a meltblown web having a blend of staple fibers which is a mixture of synthetic and cotton fibers blended therein. The wipers may be formed by a meltblowing process by extruding thermoplastic polymers as filaments into an air stream which draws and attenuates the filaments into fine fibers of an average diameter of up to about ten microns. The staple fiber mixture of synthetic and cotton fibers may be added to the air stream so that the turbulence produced by the air stream results in a uniform integration of the staple fiber mixture into the meltblown web. The meltblown fiber component of the matrix may be formed from any thermoplastic composition capable of extrusion into microfibers. It is stated that examples of such compositions include polyolefins, such as polypropylene and polyethylene, polyesters, such as polyethylene terephthalate, polyamides, such as nylon, as well as copolymers and blends of these and other thermoplastic polymers. The synthetic staple fiber component of the matrix may be selected from the same thermoplastic materials with polyester being preferred. The cotton component includes staple length cotton fibers of average length generally in the range of from about one quarter inch to three quarter inch and denier from about one to one and one half. It is stated that the process for making the material includes compacting the matrix on a forming drum and then directing it over a feed roll and between a patterned roll and an anvil roll where it is pattern bonded. The particular bond pattern is preferably selected to impart favorable textile-like tactile properties while providing strength and durability.

U.S. Pat. No. 4,426,420 to Likhyani appears to disclose a spunlaced fabric which may be made by the hydraulic entanglement of hard fibers (i.e., fibers generally having low stretch characteristics) and potentially elastomeric fibers (fibers capable of elongation by at least one hundred percent before breaking and which are capable of exhibiting elastic characteristics after having been subjected to heat treatment). After hydraulic entanglement of the two types of fibers, the fabric is heat treated to develop the elastic characteristics in the elastomeric fibers. It is stated that the hard fibers may be of any synthetic fiber-forming material, such as polyesters, polyamides, acrylic polymers and copolymers, vinyl polymers, cellulose derivatives, glass, and the like, as well as any natural fiber such as cotton, wool, silk, paper and the like, or a blend of two or more hard fibers. A representative class of potentially elastic fibers is stated to include polyetheresters and more specifically, poly(butylene terephthalate)-co-poly(tetramethyleneoxy) terephthalates.

U.S. Pat. No. 4,100,324 to Anderson et al appears to disclose a nonwoven fabric-like material including an air-formed matrix of thermoplastic polymer microfibers and a multiplicity of individualized wood pulp fibers or staple fibers such as high crimped nylon fibers. It is stated that many useful thermoplastic polymers, plyolefins such as polypropylene and polyethylene, polyamides, polyesters such as polyethylene terephthalate, and thermoplastic elastomers such as polyurethanes are anticipated to find the most widespread use in the preparation of the materials of the '324 patent.

U.S. Pat. No. 3,700,545 to Matsui appears to disclose a synthetic multi-segmented fiber which includes at least ten segments composed of at least one component of fiber-forming linear polyamide and polyester extending substantially continuously along the longitudinal direction of the fiber and occupying at least a part of the periphery of the unitary multi-segmented fiber. These fibers may be produced by spinning a multi-segment spinning material having a cross-section of grainy, nebulous or archipelagic structure.

U.S. Pat. No. 3,594,266 to Okazaki appears to disclose melt spinning of a sheath/core bicomponent fiber where one component is a polyamide and the other component is a block-copolyether amide. Okazaki also discusses meltspinning of a sheath/core bicomponent fiber having a first component of a blend of polyamide and a copolyetheramide and a second component of Nylon 6. It is stated that the latter material has 34 percent elongation.

DEFINITIONS

The term "elastic" is used herein to mean any material which, upon application of a biasing force, is stretchable to a stretched, biased length which is at least about 125 percent, that is at least about one and one quarter, of its relaxed, unbiased length, and which will recover at least about 40 percent of its stretch or elongation upon release of the stretching, elongating force. A hypothetical example which would satisfy this definition of an elastic or elastomeric material would be a one (1) inch sample of a material which is elongatable to at least 1.25 inches and which, upon being elongated to 1.25 inches and released, will return to a length of not more than 1.15 inches. Many elastic materials may be stretched by much more than 25 percent of their relaxed length, for example 100 percent, or more, and many of these will return to substantially their original relaxed length, for example, to within 105 percent of their original relaxed length upon release of the stretching, elongating force.

As used herein, the term "nonelastic" means any material which does not fall within the above definition of an elastic material.

As used herein the term "meltblown microfibers" means small diameter fibers having an average diameter not greater than about 100 microns, preferably having a diameter of from about 0.5 microns to about 50 microns, more preferably having an average diameter of from about 4 microns to about 40 microns and which are made by extruding a molten thermoplastic material through a plurality of fine, usually circular, die capillaries as molten threads or filaments into a high velocity gas (e.g. air) stream which attenuates the filaments of molten thermoplastic material to reduce their diameter to the range stated above. Thereafter, the meltblown microfibers are carried by the high velocity gas stream and are deposited on a collecting surface to form a web of randomly disbursed meltblown microfibers. Such a process is disclosed, for example, in U.S. Pat. No. 3,849,241 to Butin and the disclosure of this patent is hereby incorporated by reference.

As used herein the term "nonwoven" includes any web of material which has been formed without the use of a weaving process which produces a structure of individual fibers which are interwoven in an identifiable repeating manner. Specific examples of nonwoven webs would include, without limitation, a meltblown nonwoven web, a spunbonded nonwoven web and a carded web. Nonwoven webs generally have an average basis weight of from about 5 grams per square meter to about 300 grams per square meter. More particularly, the nonwoven webs of the present invention may have an average basis weight of from about 10 grams per square meter to about 100 grams per square meter.

As used herein the term "consisting essentially of" does not exclude the presence of additional materials which do not significantly affect the properties of a given material. Exemplary additional materials of this sort would include, without limitation, pigments, antioxidants, stabilizers, waxes, flow promoters, solvents, plasticizers particulates and materials added to enhance the processability of the material.

As used herein the term "absorbent fibers" means any fiber which is capable of absorbing at least 100 percent of its weight of a fluid.

As used herein the term "superabsorbent fiber" means any fiber which is capable of absorbing at least 400 percent of its weight of a fluid.

Unless herein specifically set forth and defined or otherwise limited, the term polymer generally includes, but is not limited to, homopolymers, copolymers, such as, for example, block, graft, random and alternating copolymers, terpolymers, etc. and blends and modifications thereof. Furthermore, unless otherwise specifically limited, the term polymer shall include all possible geometrical configurations of the material. These configurations include, but are not limited to, isotactic, syndiotactic and random symmetries and, for example, linear and radial polymers.

OBJECTS OF THE INVENTION

Accordingly, it is a general object of the present invention to provide elastic fibers which may be formed into elastic nonwoven materials such as elastic nonwoven webs.

Another general object of the present invention is to provide an elastic nonwoven web which is composed of a coherent nonwoven matrix of elastic fibers.

Yet another general object of the present invention is to provide an elastic nonwoven web which is composed of a coherent nonwoven matrix of elastic fibers with at least one other type of fiber being distributed within or on the matrix.

A further object of the present invention is to provide an elastic absorbent nonwoven web which is composed of a coherent nonwoven matrix of elastic fibers with at least one type of absorbent fiber being distributed within or on the matrix.

One other object of the present invention is to utilize polyether block amide copolymer materials to form the aforesaid elastic fibers and elastic nonwoven webs.

Still further objects and the broad scope of applicability of the present invention will become apparent to those of skill in the art from the details given hereinafter. However, it should be understood that the detailed description of the presently preferred embodiment given herein of the present invention is given only by way of illustration because various changes and modifications well within the spirit and scope of the invention will become apparent to those of skill in the art in view of this detailed description.

SUMMARY OF THE INVENTION

The present invention provides elastic meltblown fibers formed frm a polyether block amide copolymer. The elastic meltblown fibers may be formed into an elastic nonwoven web which includes a coherent nonwoven matrix of fibers, for example microfibers. The elastic nonwoven web may also include at least one type of secondary fibers, for example secondary microfibers, which are distributed within or upon the matrix. The secondary fibers may be generally uniformly distributed throughout the matrix.

The elastic fibers are formed from a polyether block amide copolymer material having the formula:

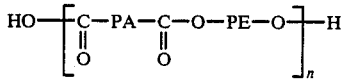

where n is a positive integer, PA represents a polyamide polymer segment and PE represents a polyether polymer segment. In particular, the polyether block amide copolymer has a melting point of from about 150° C. to about 170° C., as measured in accordance with ASTM D 789; a melt index of from about 6 grams per 10 minutes to about 25 grams per 10 minutes, as measured in accordance with ASTM D 1238, condition Q (235° C./1 Kg load); a modulus of elasticity in flexure of from about 20 MPa to about 200 MPa, as measured in accordance with ASTM D 790; a tensile strength at break of from about 29 MPa to about 33 MPa, as measured in accordance with ASTM D 638 and an ultimate elongation at break of from about 500% to about 700%, as measured by ASTM D 638.

More particularly, the polyether block amide copolymer has a melting point of about 152° C., as measured in accordance with ASTM D 789; a melt index of about 7 grams per 10 minutes, as measured in accordance with ASTM D 1238, condition Q (235° C./1 Kg load); a modulus of elasticity in flexure of about 29.50 MPa, as measured in accordance with ASTM D 790; a tensile strength at break of about 29 MPa, as measured in accordance with ASTM D 638; and an elongation at break of about 650%, as measured in accordance with ASTM D 638.

The secondary fibers, which may be microfibers, may be selected from the group including electrically conductive fibers, polyester fibers, polyamide fibers, glass fibers, polyolefin fibers, cellulosic derived fibers, multicomponent fibers, cotton fibers, silk fibers, wool fibers or blends of two or more of said secondary fibers. If the secondary fibers are polyolefin fibers, the polyolefin fibers may be selected from the group including polyethylene fibers or polypropylene fibers. If the secondary fibers are cellulosic derived fibers, the cellulosic derived fibers may be selected from the group including rayon fibers or wood pulp. If the secondary fibers are polyamide fibers, the polyamide fibers may be nylon fibers. If the secondary fibers are multi-component fibers, the multi-component fibers may be sheath-core fibers or side-by-side fibers. The secondary fibers may be absorbent or superabsorbent fibers.

If secondary fibers are present in the nonwoven elastic web, the nonwoven elastic web may generally include from about 50 percent, by weight, to about 99 percent, by weight, of fibers formed from the polyether block amide copolymer material blended with from about 1 percent, by weight to 50 percent, by weight, of the secondary fibers. For example, the elastic nonwoven web may include from about 75 percent, by weight to about 95 percent, by weight, of fibers formed from the polyether block amide copolymer blended with from about 5 percent, by weight, to about 25 percent, by weight, of the secondary fibers. More particularly, the elastic nonwoven web may include from about 85 percent, by weight, to about 95 percent, by weight, of fibers formed from the polyether block amide copolymer blended with from about 5 percent, by weight, to about 15 percent, by weight, of the secondary fibers. Further, in certain applications, particulate materials may be substituted for the secondary fibers or the elastic nonwoven web may have both secondary fibers and particulate materials incorporated into the matrix of coherent polyether block amide fibers. In such a three component system, the elastic nonwoven web may contain from about 50 percent, by weight, to about 98 percent, by weight, of the polyether block amide fibers, from about 1 percent, by weight, to about 49 percent, by weight, of secondary fibers and from about 1 percent, by weight, to about 49 percent, by weight, of particulate materials. Exemplary particulate materials are activated charcoal and powdered superabsorbent.

DETAILED DESCRIPTION OF THE INVENTION

Figure 1:
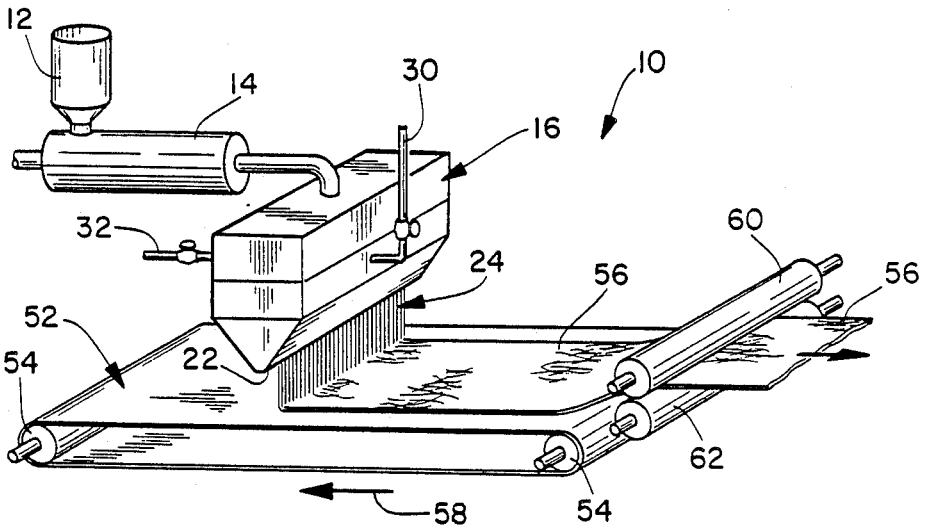
FIG. 1 is a schematic illustration of an apparatus which may be utilized to form the elastic nonwoven web of the present invention.

Turning now to the figures wherein like reference numerals represent the same or equivalent structure and, in particular, to FIG. 1 where it can be seen that an apparatus for forming the elastic nonwoven web of the present invention is schematically generally represented by reference numeral 10. In forming the elastic nonwoven web of the present invention pellets or chips, etc. (not shown) of a polyether block amide material are introduced into a pellet hopper 12 of an extruder 14.

The polyether block amide copolymer may be obtained under the trade designation Pebax from ATO Chimie of Paris, France. ATO Chimie literature states that the polyether block amide Pebax includes linear and regular chains of rigid polyamide segments and flexible polyether segments and has the general formula of:

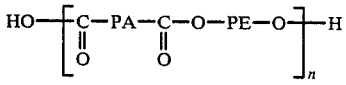

where PA represents a polyamide segment, PE represents a polyether segment and n is a positive integer.

Several grades of Pebax are available under the trade designations Pebax 2533 SN 00, Pebax 3533 SN00, Pebax 4033 SN 00 and Pebax 5533 SN 00. Chimie literature reports certain properties of these materials which are summarized below in Table I.

TABLE I

| PROPERTY | PEBAX 2533 SN 00 | PEBAX 3533 SN 00 | PEBAX 4033 SN 00 | PEBAX 5533 SN 00 | MEASURED BY ASTM STANDARD |
|---|---|---|---|---|---|
| Density | 1.01 | 1.01 | 1.01 | 1.01 | D 792 |
| Melting Point (deg. C.) | 148 | 152 | 168 | 168 | D 789 |
| Latent Heat of Fusion (Cal/g) | 1.2 | 2.6 | 5.7 | 6.2 | D 3417 |
| Water absorption at equilibrium at 20° and 65% RH (%) | 0.5 | 0.5 | 0.5 | 0.5 | D 570 |
| Melt index at 235° C. under a 1 Kg load (grams/10 min.) | 6 | 7 | 7 | 8 | D 1238 |
| Tensile strength at break (MPa) | 29 | 29 | 33 | 33 | D 638 |
| Elongation at break (%) | 680 | 650 | 620 | 510 | D 638 |
| Max. flexure (mm) | 26 | 31 | 24 | 24 | D 790 |
| Stress at max. flexure (MPa) | 1 | 2 | 6 | 10 | D 790 |
| Modulus of elasticity in flexure (MPa) | 20 | 29.50 | 105 | 200 | D 790 |

From the table, above, it can be seen that these Pebax polyether block amide copolymer materials have a melting point of from about 150° C. to about 170° C., when measured in accordance with ASTM D 789; a latent heat of fusion of from about 1 Cal/g to about 6 Cal/g, when measured in accordance with ASTM D 3417, a water absorption at equilibrium at 20° C. and 65% RH of about 0.5% when measured in accordance with ASTM D 570, a melt index of from about 6 grams per 10 minutes to about 8 grams per 10 minutes, when measured in accordance with ASTM D 1238 at 235° C. under a 1 Kg load (condition Q), a tensile strength at break of from about 29 MPa to about 33 MPa, when measured in accordance with ASTM D 638, an elongation at break of from about 500% to about 700%, when measured in accordance with ASTM D 638, a maximum flexure of from about 25 mm to about 30 mm, when measured in accordance with ASTM D 790, a stress at maximum flexure of from about 1 MPa to about 10 MPa when measured in accordance with ASTM D 790 and a modulus of elasticity in flexure of from about 20 MPa to about 200 MPa, when measured in accordance with ASTM D 790. The polyether block amide copolymer may be mixed with other appropriate materials, such as, for example, pigments, anti-oxidants, stabilizers, waxes, flow promoters, solid solvents, particulates and processing enhancing additives, prior to its introduction into the hopper 12.

The extruder 14 has an extrusion screw (not shown) which is driven by a conventional drive motor (not shown). As the polyether block amide copolymer advances through the extruder 14, due to rotation of the extrusion screw by the drive motor, it is progressively heated to a molten state. Heating of the polyether block amide to the molten state may be accomplished in a plurality of discrete steps with its temperature being gradually elevated as it advances through discrete heating zones of the extruder 14 toward a meltblowing die 16. The die 16 may be yet another heating zone where the temperature of the thermoplastic resin is maintained at an elevated level for extrusion. The temperature which will be required to heat the polyether block amide polymer to a molten state will vary somewhat depending upon which grade of polyether block amide is utilized and can be readily determined by those in the art. However, generally speaking, the Pebax polyether block amide may be extruded within the temperature range of from about 200 degrees Centigrade to about 350 degrees Centigrade. For example, the extrusion may be accomplished within a temperature range of from about 250 degrees Centigrade to about 300 degrees Centigrade. Heating of the various zones of the extruder 14 and the meltblowing die 16 may be achieved by any of a variety of conventional heating arrangements (not shown).

Figure 2:
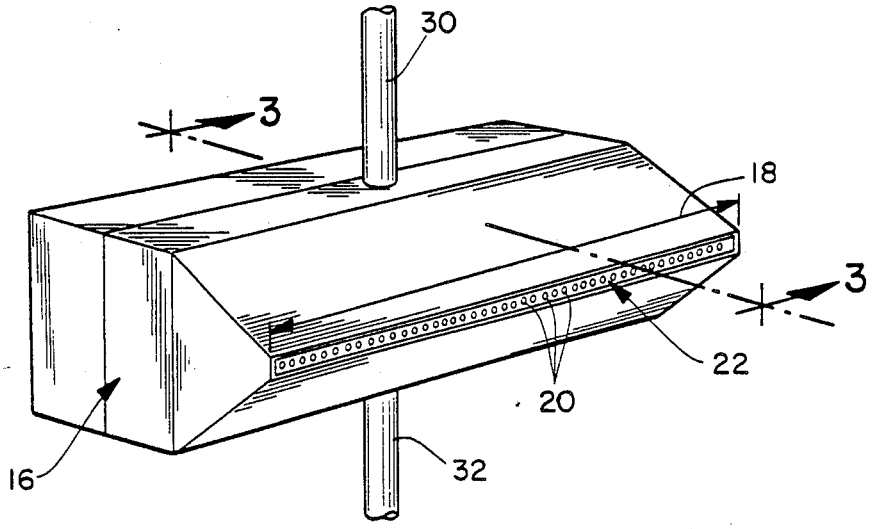
FIG. 2 is a bottom view of the die of FIG. 1 with the die having been rotated 90 degrees for clarity.

FIG. 2 illustrates that the lateral extent 18 of the die 16 is provided with a plurality of orifices 20 which are usually circular in cross-section and are linearly arranged along the extent 18 of the tip 22 of the die 16. The orifices 20 of the die 16 may have diameters that range from about 0.01 of an inch to about 0.02 of an inch and a length which may range from about 0.05 inches to about 0.20 inches. For example, the orifices may have a diameter of about 0.0145 inches and a length of about 0.113 inches. From about 5 to about 50 orifices may be provided per inch of the lateral extent 18 of the tip 22 of the die 16 with the die 16 extending from about 30 inches to about 60 inches or more. FIG. 1 illustrates that the molten polyether block amide copolymer emerges from the orifices 20 of the die 16 as molten strands or threads 24.

Figure 3:
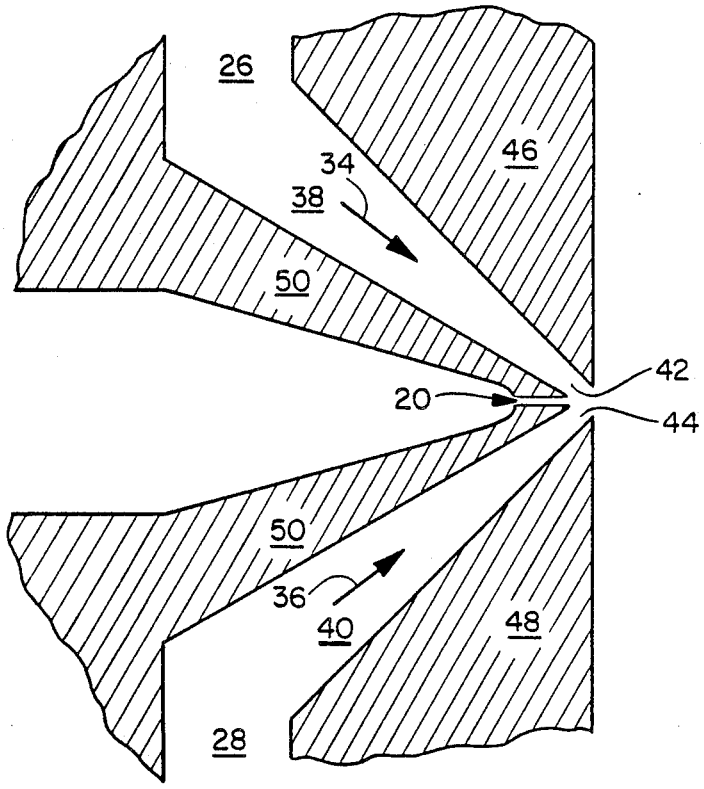
FIG. 3 is a cross-sectional view of the die of FIG. 1 taken along line 3—3 of FIG. 2.

FIG. 3, which is a cross-sectional view of the die of FIG. 2 taken along line 3—3, illustrates that the die 16 preferably includes attenuating gas inlets 26 and 28 which are provided with heated, pressurized attenuating gas (not shown) by attenuating gas sources 30 and 32. (See FIG. 1. The heated, pressurized attenuating gas enters the die 16 at the inlets 26 and 28 and follows a path generally designated by the arrows 34 and 36 through the two chambers 38 and 40 and on through the two narrow passageways or gaps 42 and 44 so as to contact the extruded threads 24 as they exit the orifices 20 of the die 16. The chambers 38 and 40 are designed so that the heated attenuating gas passes through the chambers 38 and 40 and exits the gaps 42 and 44 to form a stream (not shown) of attenuating gas which exits the die 16 on both sides of the threads 24. The temperature and pressure of the heated stream of attenuating gas can vary widely. For example, the heated attenuating gas can be applied at a temperature of from about 100 degrees Centigrade to about 500 degrees Centigrade, more particularly, from about 300 degrees Centigrade to about 400 degrees Centigrade. The heated attenuating gas may generally be applied at a pressure of from about 0.5 pounds per square inch, gage to about 20 pounds per square inch, gage.

The position of air plates 46 and 48 which, in conjunction with a die portion 50 define the chambers 38 and 40 and the gaps 42 and 44, may be adjusted relative to the die portion 50 to increase or decrease the width of the attenuating gas passageways 42 and 44 so that the volume of attenuating gas passing through the air passageways 42 and 44 during a given time period can be varied without varying the velocity of the attenuating gas. Furthermore, the air plates 46 and 48 are preferably adjusted to effect a "recessed" die-tip configuration as illustrated in FIG. 3. Generally speaking, a recessed die-tip configuration and attenuating gas pressures of less than 20 pounds per square inch, gage are used in conjunction with air passageway widths, which are usually the same and are no greater in width than about 0.20 inches. Lower attenuating gas velocities and wider air passageway gaps are generally preferred if substantially continuous meltblown fibers or microfibers 24 are to be produced.

The two streams of attenuating gas converge to form a stream of gas which entrains and attenuates the molten threads 24, as they exit the orifices 20, into fibers or, depending upon the degree of attenuation, microfibers, of a small diameter which is usually less than the diameter of the orifices 20. The gas-borne fibers or microfibers 24 are blown, by the action of the attenuating gas, onto a collecting arrangement which, in the embodiment illustrated in FIG. 1, is a foraminous endless belt 52 conventionally driven by rollers 54. Other foraminous arrangements such as a rotating drum could be utilized. One or more vacuum boxes (not illustrated) may be located below the surface of the foraminous belt 52 and between the rollers 54. The fibers or microfibers 22, which are cohesive, are collected as a matrix of coherent nonwoven fibers on the surface of the endless belt 52 which is rotating as indicated by the arrow 58 in FIG. 1. The vacuum boxes assist in retention of the matrix on the surface of the belt 52. Typically the tip 22 of the die 16 is from about 4 inches to about 24 inches from the surface of the foraminous belt 52 upon which the fibers are collected. The thus-collected, entangled fibers or microfibers 24 are coherent and thus may be removed from the belt 52 as a self-supporting nonwoven web 56 by a pair of pinch rollers 60 and 62 which may be designed to press the fibers of the web 56 together to improve the integrity of the web 56.

Figure 4:
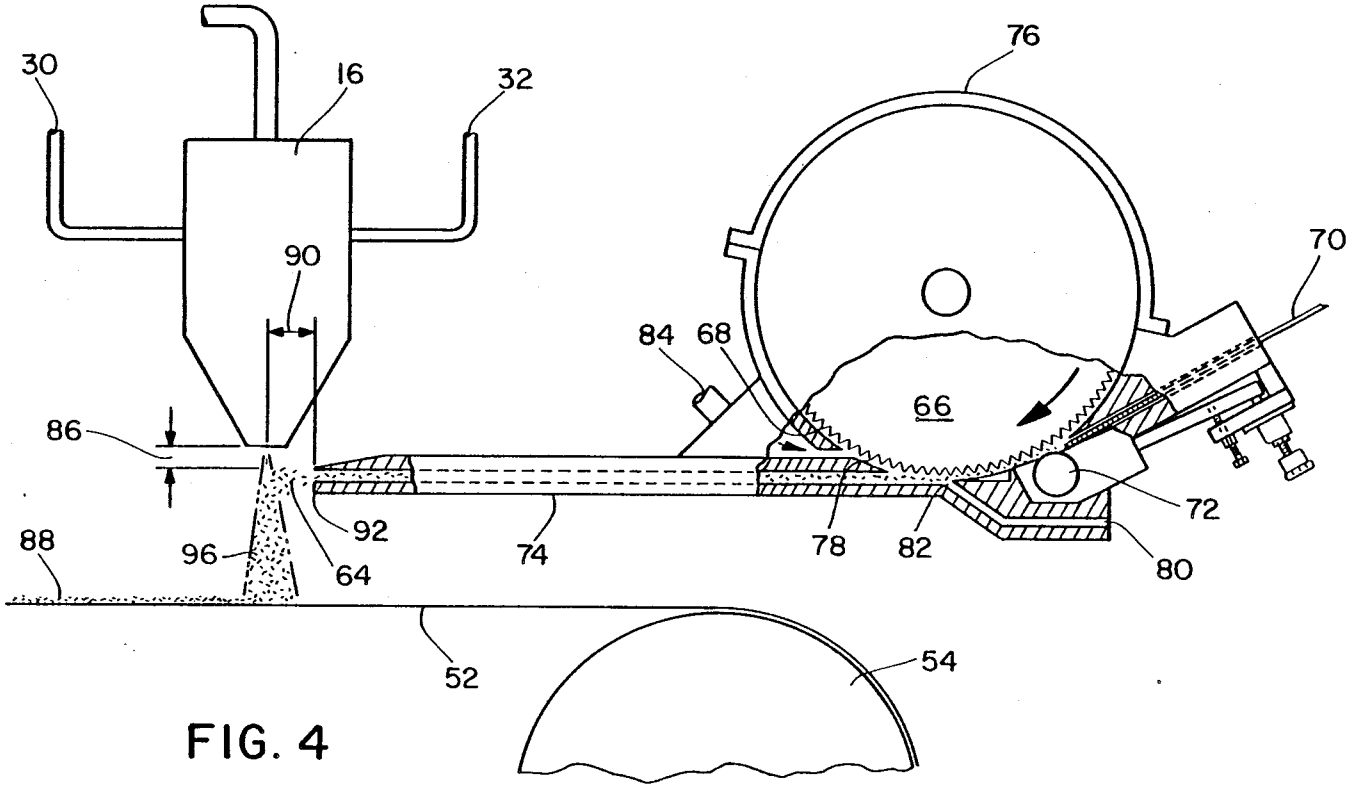
FIG. 4 is a schematic illustration of an apparatus which may be utilized to form the embodiment of the present invention where secondary fibers are incorporated into the matrix of coherent polyether block amide fibers.

FIG. 4 illustrates another embodiment of the present invention where one or more types of secondary fibers 64 are distributed within or upon the stream of thermoplastic fibers or microfibers 24. Distribution of the secondary fibers 64 within the stream of fibers 24 may be such that the secondary fibers 64 are generally uniformly distributed throughout the stream of polyether block amide copolymer fibers 24. This may be accomplished by merging a secondary gas stream (not shown) containing the secondary fibers 64 with the stream of fibers 24. Apparatus for accomplishing this merger may include a conventional picker roll 66 arrangement which has a plurality of teeth 68 that are adapted to separate a mat or batt 70 of secondary fibers into the individual secondary fibers 64. The mat or batt of secondary fibers 70 which is fed to the picker roll 66 may be a sheet of pulp fibers (if a two component mixture of polyether block amide copolymer fibers and secondary pulp fibers is desired), a mat of staple fibers (if a two component mixture of polyether block amide copolymer fibers and secondary staple fibers is desired) or both a sheet of pulp fibers and a mat of staple fibers (if a three component mixture of polyether block amide copolymer fibers, secondary staple fibers and secondary pulp fibers is desired). In embodiments where, for example, an absorbent material is desired from the composite material, the secondary fibers 64 are absorbent fibers. The secondary fibers 64 may generally be selected from the group including one or more polyester fibers, polyamide fibers, polyolefin fibers such as, for example, polyethylene fibers and polypropylene fibers, cellulosic derived fibers such as, for example, rayon fibers and wood pulp fibers, multi-component fibers such as, for example, sheath-core multi-component fibers or side-by-side multi-component fibers, cotton fibers, silk fibers, wool fibers or blends of two or more of such secondary fibers. Other types of secondary fibers 64 as well as blends of two or more of other types of secondary fibers 64 may be utilized. The secondary fibers 64 may be microfibers or the secondary fibers 64 may be macrofibers having an average diameter of from about 300 microns to about 1,000 microns.

The secondary fibers 64 of the present invention may generally be distinguished from the elastic fibers of the present invention in that the secondary fibers 64 are nonelastic.

The sheets or mats 70 of secondary fibers 64 are fed to the picker roll 66 by a roller arrangement 72. After the teeth 68 of the picker roll 66 have separated the mat of secondary fibers 70 into separate secondary fibers 64 the individual secondary fibers 64 are conveyed toward the stream of polyether block amide copolymer fibers or microfibers 24 through a nozzle 74. A housing 76 encloses the picker roll 66 and provides a passageway or gap 78 between the housing 76 and the surface of the teeth 68 of the picker roll 66. A gas (not shown), for example air, is supplied to the passageway or gap 78 between the surface of the picker roll 66 and the housing 76 by way of a gas duct 80. The gas duct 80 may enter the passageway or gap 78 generally at the junction 82 of the nozzle 74 and the gap 78. The gas is supplied in sufficient quantity to serve as a medium for conveying the secondary fibers 64 through the nozzle 74. The gas supplied from the duct 80 also serves as an aid in removing the secondary fibers 64 from the teeth 68 of the picker roll 66. However, gas supplied through the duct 84 generally provides for removal of the secondary fibers 64 from the teeth of the picker roll 66. The gas may be supplied by any conventional arrangement such as, for example, an air blower (not shown).

Generally speaking, the individual secondary fibers 64 are conveyed through the nozzle 74 at generally the velocity at which the secondary fibers 64 leave the teeth 68 of the picker roll 66. In other words, the secondary fibers 64, upon leaving the teeth 68 of the picker roll 66 and entering the nozzle 74, generally maintain their velocity in both magnitude and direction from the point where they left the teeth 68 of the picker roll 66. Such an arrangement, which is discussed in more detail in U.S. Pat. No. 4,100,324 to Anderson et al., hereby incorporated by reference, aids in substantially reducing fiber floccing.

As an aid in maintaining satisfactory secondary fiber 64 velocity, the nozzle 74 may be positioned so that its longitudinal axis is substantially parallel to a plane which is tangent to the picker roll 66 at the junction 82 of the nozzle 74 with the passageway 78. As a result of this configuration, the velocity of the secondary fibers 64 is not substantially changed by contact of the secondary fibers 64 with the walls of the nozzle 74. If the secondary fibers 64 temporarily remain in contact with the teeth 68 of the picker roll 66 after they have been separated from the mat or batt 70, the axis of the nozzle 74 may be adjusted appropriately to be aligned with the direction of secondary fiber 64 velocity at the point where the secondary fibers 64 disengage from the teeth 68 of the picker roll 66. The disengagement of the secondary fibers 64 from the teeth 68 of the picker roll 66 may be assisted by application of a pressurized gas, i.e., air through duct 84.

The vertical distance 86 that the nozzle 74 is below the die tip 22 may be adjusted to vary the properties of the composite web 88. Variation of the horizontal distance 90 of the tip 92 of the nozzle 74 from the die tip 24 will also achieve variations in the final elastic nonwoven web 88. The vertical distance 86 and the horizontal distance 90 values will also vary with the material being added to the polyether block amide copolymer fibers 24. The width of the nozzle 74 along the picker roll 66 and the length that the nozzle 74 extends from the picker roll 66 are also important in obtaining optimum distribution of the secondary fibers 64 throughout the stream of fibers 24. It is usually desirable for the length of the nozzle 74 to be as short as equipment design will allow. The length is usually limited to a minimum length which is generally equal to the radius of the picker roll 66. Usually, the width of the nozzle 74 should not exceed the width of the sheets or mats 70 that are being fed to the picker roll 66.

The picker roll 66 may be replaced by a conventional particulate injection system to form a composite nonwoven web 88 containing various secondary particulates. A combination of both secondary particulates and secondary fibers could be added to the polyether block amide copolymer fibers prior to formation of the composite nonwoven web 88 if a conventional particulate injection system was added to the system illustrated in FIG. 4.

FIG. 4 further illustrates that the gas stream carrying the secondary fibers 64 is moving in a direction which is generally perpendicular to the direction of movement of the stream of polyether block amide copolymer fibers 24 at the point of merger of the two streams. Other angles of merger of the two streams may be utilized. The velocity of the gas stream of secondary fibers 64 is usually adjusted so that it is less than the velocity of the stream of polyether block amide copolymer fibers 24. This allows the streams, upon merger and integration thereof to flow in substantially the same direction as that of the stream of polyether block amide copolymer fibers 24. Indeed, the merger of the two streams may be accomplished in a manner which is somewhat like an aspirating effect where the stream of secondary fibers 64 is drawn into the stream of polyether block amide copolymer fibers 24. If desired, the velocity difference between the two gas streams may be such that the secondary fibers 64 are integrated into the polyether block amide copolymer fibers 24 in a turbulent manner so that the secondary fibers 64 become substantially thoroughly and uniformly mixed throughout the polyether block amide copolymer fibers 24. Generally, for increased production rates the gas stream which entrains and attenuates the stream of polyether block amide copolymer fibers 24 should have a comparatively high initial velocity, for example from about 200 feet to over 1,000 feet per second, and the stream of gas which carries the secondary fibers 64 should have a comparatively low initial velocity, for example from about 50 to about 200 feet per second. After the stream of gas that entrains and attenuates the polyether block amide copolymer fibers 24 exits the gaps 42 and 44 of the die 16, it immediately expands and decreases in velocity.

Upon merger and integration of the stream of secondary fibers 64 into the stream of polyether block amide copolymer fibers 24 to generally uniformly distribute the secondary fibers 64 throughout the stream of polyether block amide copolymer fibers 24, a composite stream 96 of thermoplastic fibers 22 and secondary fibers 64 is formed. Due to the fact that the polyether block amide copolymer fibers 24 are usually still semi-molten and tacky at the time of incorporation of the secondary fibers 64 into the polyether block amide copolymer fibers 24, the secondary fibers 64 are usually not only mechanically entangled within the matrix formed by the polyether block amide copolymer fibers 24 but are also thermally bonded or joined to the polyether block amide copolymer fibers 24.

In order to convert the composite stream 96 of polyether block amide copolymer fibers 24 and secondary fibers 64 into a composite elastic nonwoven web or mat 88 composed of a coherent matrix of the polyether block amide copolymer fibers 24 having the secondary fibers 64 generally uniformly distributed therein, a collecting device is located in the path of the composite stream 96. The collecting device may be the endless belt 52 of FIG. 1 upon which the composite stream 96 impacts to form the composite nonwoven web 56. The belt 52 is usually porous and a conventional vacuum arrangement (not shown) which assists in retaining the composite stream 96 on the external surface of the belt 52 is usually present. Other collecting devices are well known to those of skill in the art and may be utilized in place of the endless belt 52. For example, a porous rotating drum arrangement could be utilized. Thereafter, the composite elastic nonwoven web 88 is removed from the screen by the action of rollers such as roller 60 and 62 shown in FIG. 1.

EXAMPLE I

A fibrous nonwoven elastic web was formed by meltblowing a polyether block amide copolymer obtained from the ATO Chimie Company under the trade designation Pebax 3533.

Meltblowing of the fibrous nonwoven elastic web was accomplished by extruding the thermoplastic elastomer through a 1.5 inch diameter Johnson extruder and through a meltblowing die having thirty extrusion capillaries per lineal inch of die tip. The capillaries each had a diameter of about 0.0145 inches and a length of about 0.113 inches. The polyether block amide was extruded through the capillaries at a rate of about 0.19 grams per capillary per minute at a temperature of about 304 degrees Centigrade. The extrusion pressure exerted upon the polyether block amide in the die tip was measured as 93 pounds per square inch, gage. The die tip configuration was adjusted so that it was recessed about 0.080 inches (−0.080 die tip stickout) from the plane of the external surface of the lips of the air plates which form the air passageways on either side of the capillaries. The air plates were adjusted so that the two air passageways, one on each side of the extrusion capillaries, formed air passageways of a width or gap of about 0.060 inches. Forming air for meltblowing the polyether block amide was supplied to the air passageways at a temperature of about 301 degrees Centigrade and at a pressure of about 3.0 pounds per square inch, gage. The viscosity of the polyether block amide was calculated at 250 poise in the capillaries. The meltblown fibers thus formed were blown onto a formng screen which was approximately 12 inches from the die tip.

EXAMPLE II

A fibrous nonwoven elastic web was formed by meltblowing a polyether block amide copolymer obtained from the ATO Chimie Company under the trade designation Pebax 3533.

Meltblowing of the fibrous nonwoven elastic web was accomplished by extruding the thermoplastic elastomer through a 1.5 inch diameter Johnson extruder and through a meltblowing die having thirty extrusion capillaries per lineal inch of die tip. The capillaries each had a diameter of about 0.0145 inches and a length of about 0.113 inches. The polyether block amide was extruded through the capillaries at a rate of about 0.19 grams per capillary per minute at a temperature of about 304 degrees Centigrade. The extrusion pressure exerted upon the polyether block amide in the die tip was measured as 93 pounds per square inch, gage. The die tip configuration was adjusted so that it was recessed about 0.080 inches (−0.080 die tip stickout) from the plane of the external surface of the lips of the air plates which form the air passageways on either side of the capillaries. The air plates were adjusted so that the two air passageways, one on each side of the extrusion capillaries, formed air passageways of a width or gap of about 0.060 inches. Forming air for meltblowing the polyether block amide was supplied to the air passageways at a temperature of about 299 degrees Centigrade and at a pressure of about 5.0 pounds per square inch, gage. The viscosity of the polyether block amide was calculated at 250 poise in the capillaries. The meltblown fibers thus formed were blown onto a forming screen which was approximately 12 inches from the die tip.

EXAMPLE III

A fibrous nonwoven elastic web was formed by meltblowing a polyether block amide copolymer obtained from ATO Chimie under the trade designation Pebax 3533 and injecting staple fibers, obtained from DuPont under the trade designation Dacron polyester Hollofil 808.

Coforming of the fibrous nonwoven elastic web was accomplished by extruding the thermoplastic elastomer through a 1.5 inch diameter Johnson extruder and through a meltblowing die having thirty extrusion capillaries per lineal inch of die tip. The capillaries each had a diameter of about 0.0145 inches and a length of about 0.113 inches. The polyether block amide was extruded through the capillaries at a rate of about 0.22 grams per capillary per minute at a temperature of about 306 degrees Centigrade. The extrusion pressure exerted upon the polyether block amide in the die tip was measured as 158 pounds per square inch, gage. The die tip configuration was adjusted so that it was recessed about 0.080 inches (−0.080 die tip stickout) from the plane of the external surface of the lips of the air plates which form the air passageways on either side of the capillaries. The air plates were adjusted so that the two air passageways, one on each side of the extrusion capillaries, formed air passageways of a width or gap of about 0.060 inches. Forming air for meltblowing the polyether block amide was supplied to the air passageways at a temperature of about 288 degrees Centigrade and at a pressure of about 3.0 pounds per square inch, gage. The viscosity of the polyether block amide was calculated at 355 poise in the capillaries.

To incorporate the staple fibers into the meltblown web, a conventional coforming technique and apparatus as disclosed in U.S. Pat. No. 4,100,324 to Anderson et al. was used. Staple fibers obtained from DuPont under the trade designation Dacron polyester Hollofil were incorporated into the stream of meltblown fibers prior to their deposition upon the forming screen. The polyester fibers were first formed, by a Rando Webber mat forming apparatus, into a mat having an approximate basis weight of about 100 grams per square meter. The mat was fed to the picker roll by a picker roll feed roll which was positioned about 0.005 inches from the surface of the picker roll. The picker roll was rotating at a rate of about 3,000 revolutions per minute. Actual measurement of the position of the nozzle of the coform apparatus with respect to the stream of meltblown fibers was not made. However, it is believed that the nozzle of the coforming apparatus was positioned about 2 inches below the die tip of the meltblowing die and about 2 inches back from the die tip of meltblown die.

The elastomeric characteristics of the fibrous nonwoven webs formed in Examples 1, 2 and 3 were measured. The testing was accomplished by utilization of an Instron tensile tester model 1130 which elongated each sample at a rate of 4 inches per minute. Each sample was 3 inches wide (transverse machine direction) by 5 inches long (machine direction) and the initial jaw separation was 4 inches. The samples were placed lengthwise in the tester. The data which was obtained is tabulated in Table II.

TABLE II

| Example | Basis Wt. (gsm) | MD Tensile[1] g/3 | MD Elongation[2] % | Permanent Set[3] % |
|---|---|---|---|---|
| 1 | 105 | 5665 | 536 | 12.5 |
| 1 | 129 | 6652 | 518 | 11.3 |
| 1 | 111 | 5962 | 521 | 13.1 |
| AVE. | 115 | 6093 | 525 | 12 |
| S. DEV. | 12 | 506 | 10 | 1 |
| 2 | 86 | 3200 | 365 | 15.0 |
| 2 | 85 | 3443 | 411 | 14.4 |
| 2 | 86 | 3142 | 346 | 12.5 |
| AVE. | 86 | 3262 | 375 | 14 |
| S. DEV. | 1 | 160 | 33 | 1 |
| 3 | 114 | 1237 | 180 | 28.1 |
| 3 | 114 | 1362 | 166 | 31.3 |
| 3 | 99 | 1181 | 152 | 30.6 |
| AVE. | 109 | 1260 | 166 | 30 |
| S. DEV. | 9 | 93 | 14 | 2 |

Footnotes for Table II

[1]in grams per 3 inch wide sample

[2]as a percentage increase of the length of the original unstretched sample. For example, 100 percent would equal twice the length of the original unstretched sample

[3]as a percentage increase in the initial length after elongating to 100% for 1 minute While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A composite elastic nonwoven web comprised of: from about 50–99 percent, by weight, of a coherent matrix of meltblown fibers of a polyether block amide copolymer having the formula:

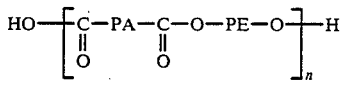

where n is a positive integer, PA represents a polyamide segment and PE represents a polyether segment; and from about 1–50 percent, by weight, of at least one type of other fibers.

2. The composite elastic nonwoven web of claim 1, wherein the polyether block amide has a melting point of from about 150 degrees C. to about 170 degrees C., as measured in accordance with ASTM D 789.

3. The composite elastic nonwoven web according to claim 1, wherein the polyether block amide has a melt index of from about 6 grams per 10 minutes to about 8 grams per 10 minutes, as measured in accordance with ASTM D 1238, condition Q.

4. The composite elastic nonwoven web of claim 1, wherein the polyether block amide has a modulus of elasticity in flexure of from about 20 MPa to about 200 MPa, as measured in accordance with ASTM D 790.

5. The composite elastic nonwoven web according to claim 1, wherein the polyether block amide has a tensile strength at break of from about 29 MPa to about 33 MPa and an elongation of from about 500 percent to about 700 percent, both as measured in accordance with ASTM D 638.

6. The composite elastic nonwoven web of claim 1, wherein said other fibers are distributed generally uniformly throughout said matrix.

7. The composite elastic nonwoven web of claim 1, wherein the meltblown fibers are microfibers.

8. The composite elastic nonwoven web of claim 1, wherein the other fibers are selected from the group consisting of polyester fibers, polyamide fibers, glass fibers, polyolefin fibers, cellulosic derived fibers, multicomponent fibers, silk fibers, wool fibers, absorbent fibers and electrically conductive fibers.

9. The composite elastic nonwoven web of claim 8, wherein said polyolefin fibers are selected from the group consisting of polyethylene fibers and polypropylene fibers.

10. The composite elastic nonwoven web of claim 8, wherein the cellulosic derived fibers are selected from the group consisting of rayon fibers, wood pulp fibers and cotton fibers.

11. The composite elastic nonwoven web of claim 8, wherein said polyamide fibers are nylon fibers.

12. The composite elastic nonwoven web according to claim 8, wherein said multi-component fibers are selected from the group consisting of sheath-core fibers and side-by-side fibers.

13. A composite elastic nonwoven web consisting essentially of:

from about 50–99 percent, by weight, of a coherent matrix of meltblown fibers which consists of a polyether block amide copolymer having the formula of

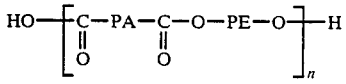

where n is a positive integer, PA represents a polyamide segment and PE represents a polyether segment; and from about 1–50 percent, by weight, of at least one type of other fibers; and wherein said polyether block amide has:

a melting point of about 152 degrees C., as measured in accordance with ASTM D 789;

a melt index of about 7 grams per 10 minutes as measure in accordance with ASTM D 1238, condition Q;

a modulus of elasticity in flexure of about 29.50 MPA, as measured in accordance with ASTM D 790; and a tensile strength at break of aboaut 29 MPA and an elongation at break of about 650 percent, both as measured in accordance with ASTM D 638.

14. The composite elastic nonwoven web of claim 1, comprised of from about 75–95 percent, by weight, of said coherent matrix and from about 5–25 percent, by weight, of said other fibers.

15. The composite elastic nonwoven web of claim 1, comprised of from about 85–95 percent, by weight, of said coherent matrix and from about 5–15 percent, by weight, of said other fibers.

* * * * *

UNITED STATES PATENT AND TRADEMARK OFFICE

CERTIFICATE OF CORRECTION

PATENT NO. : 4,820,572

DATED : April 11, 1989

INVENTOR(S) : Thomas M. Killian, et al.

It is certified that error appears in the above—identified patent and that said Letters Patent is hereby corrected as shown below:

Column 2, line 65-66, "plyolefins" should read --polyolefins--;

Column 4, line 16, "plasticizers" should read --plasticizers,--;

Column 5, line 4, "frm" should read --from--; and

Column 8, line 45 "(Fig. 1" should read --(Fig. 1).

Signed and Sealed this

Nineteenth Day of May, 1992

*Attest:*

DOUGLAS B. COMER

*Attesting Officer*

*Acting Commissioner of Patents and Trademarks*